United States Patent [19]

Maxwell

[11] Patent Number: 4,957,302

[45] Date of Patent: Sep. 18, 1990

[54] WORKER SUPPORT APPARATUS

[75] Inventor: Donald J. Maxwell, Lincoln, Nebr.

[73] Assignee: Eidos Corporation, David City, Nebr.

[21] Appl. No.: 311,175

[22] Filed: Feb. 15, 1989

[51] Int. Cl.[5] ..... B25H 5/00

[52] U.S. Cl. ..... 280/32.6; 297/261; 297/325; 297/DIG. 4

[58] Field of Search ..... 280/32.5, 32.6, 250.1; 297/325, 261, 262, DIG. 4, 353, 354, 355, 356, 363, 364, 365

[56] References Cited

U.S. PATENT DOCUMENTS

| | | | |
|---|---|---|---|
| 2,054,557 | 9/1936 | Cramer et al. | 297/364 |
| 2,154,952 | 4/1939 | Mahloch | 280/32.6 |
| 2,748,835 | 6/1956 | Barecki | 297/363 |
| 2,796,155 | 6/1957 | Cabler | 280/32.5 |
| 4,383,714 | 5/1983 | Ishida | 297/325 |

*Primary Examiner*—Mitchell J. Hill

*Attorney, Agent, or Firm*—Hovey, Williams, Timmons & Collins

[57] ABSTRACT

A support apparatus for selectively supporting a human being in one of a plurality of positions includes a support structure and a seat assembly having a frame and a seat mounted on the frame for movement therewith. The seat assembly is positionable relative to support structure along an arcuate path defined by an arcuate guide track provided on one of the frame and support structure. A plurality of rollers are rotatably supported on the other of the frame and support structure, the rollers engaging the guide track to support the seat assembly on the support structure and being movable relative to the guide track to permit movement of the seat assembly relative to the support structure. A back support member may be pivotally mounted on the frame to permit selective positioning of the back support member in one of a plurality of positions relative to the seat while moving with the seat during movement of the seat assembly relative to the support structure.

18 Claims, 3 Drawing Sheets

FIG. 1.
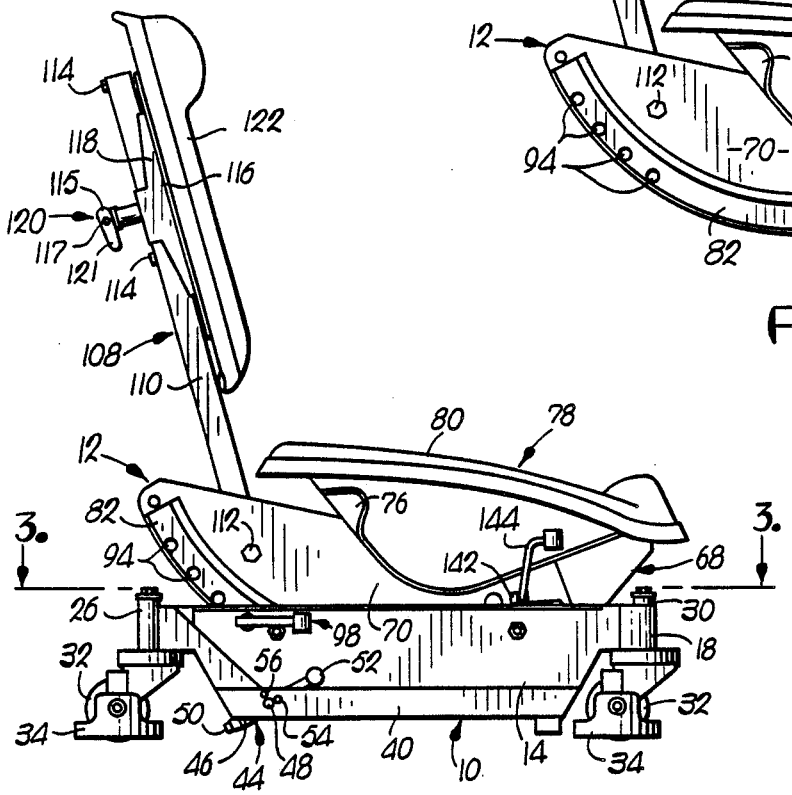
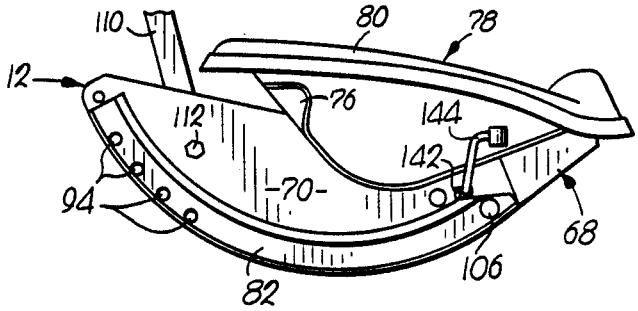
FIG. 4.
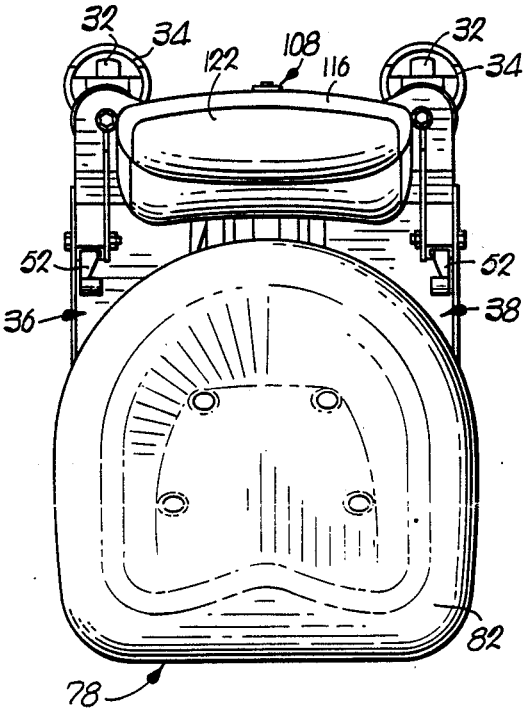
FIG. 2.
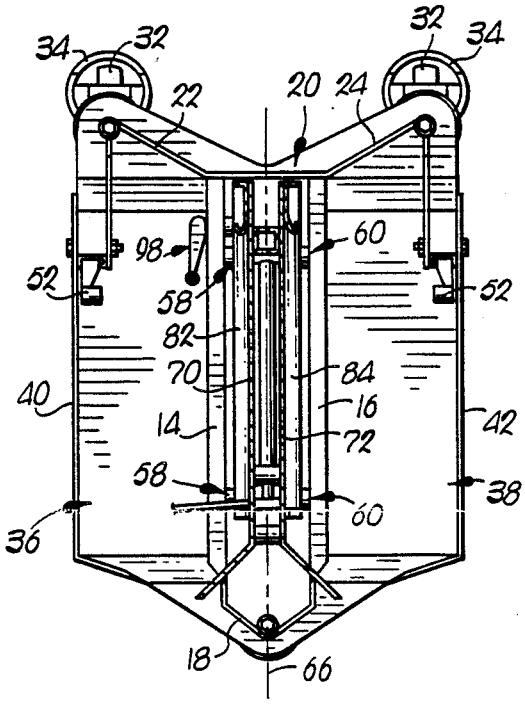
FIG. 3.

WORKER SUPPORT APPARATUS

BACKGROUND OF THE INVENTION

1. Field of the Invention

The present invention relates generally to worker support devices and, more particularly, to a support apparatus for selectively supporting a worker in one of a plurality of positions ranging from a substantially horizontal supine position to an upright seated position.

2. Discussion of the Prior Art

Many manufacturing operations presently exist which require workers to position themselves in any of a number of unnatural positions ranging between a substantially horizontal supine position in which the workers are more or less on their backs, and an upright seated position. For example, in the aviation industry, during the construction and maintenance of an aircraft, numerous hours are spent by workers performing operations beneath the wings or fuselage thereof or in and around the aircraft's landing equipment.

Typically, in the construction of aircraft, a partly assembled plane is supported on a plurality of screw jacks, at least one of which supports either the front or rear of the fuselage at least two of these are positioned beneath the wings. Once supported in this manner, the plane may be moved if desired from station to another station along an assembly line so that different assembly operations may be performed on the plane. At several of these assembly stations, work is carried out by as many as three to five workers working simultaneously together beneath the plane in and around the support jacks.

Because the workers must perform these assembly operations in cramped quarters with substantially no head room, they are often in uncomfortable working positions for a substantial portion of time. Thus, frequent breaks are necessitated in order to prevent the workers from being over-stressed or cramped.

Therefore, a significant and heretofore unsolved need exists in the aviation industry for example, for provision of a support device that will permit workers to stay at their job for longer periods of time by providing ergonomic support for the workers in a plurality of different positions ranging from a substantially horizontal supine position in which the workers are more or less on their backs to an upright seated position.

Although the need for an adjustable worker support chair is particularly acute in the aviation industry, a similar problem exists in other fields where workers must position themselves for long time periods in work stations below an overhead structure, or in any unusual altitude where it is uncomfortable to maintain the required position for an extended interval.

Creepers have long been available to support workers during repair operations on the underside of automobiles, trucks, tractors and similar equipment but these devices are not useful when the worker is unable to reach a point above him while lying flat on his back while supported by the rollable creeper.

OBJECTS AND SUMMARY OF THE INVENTION

It is an object of the present invention to provide a support apparatus for a worker which permits a full range of movement between a supine position and a seated position while providing ergonomic comfort at any selected position. By providing such a construction, it is an additional object of the invention to provide a support apparatus which permits a worker to remain comfortably at a work station for longer periods of time without requiring a break in order to increase the productivity of the worker.

Further, it is an object of the invention to provide a support apparatus small enough to be used in and around aircraft support structures commonly employed in the aviation industry and which are sized to permit a plurality of such support apparatuses to be employed side-by-side in a cramped space as is provided in numerous types of work environments.

In accordance with the invention, a support apparatus comprises a support structure and a seat assembly including a frame, a seat, and a back support member. The seat and back support member are mounted on the frame for movement with the frame. In addition, seat assembly positioning means is provided for permitting movement of the frame relative to the support assembly along an arcuate path to selectively position the seat assembly in one of a plurality of positions relative to the support structure. Back support positioning means is also provided in accordance with one aspect of the invention for allowing pivotal movement of the back support member relative to the frame to selectively position the back support member in one of a plurality of positions relative to the seat.

In another aspect of the invention, the seat assembly includes a frame and a seat mounted on the frame for movement therewith, and seat positioning means is provided for permitting movement of the seat assembly relative to the support structure along an arcuate path to selectively position the seat assembly in one of a plurality of positions relative to the support structure. According to this facet of the invention, the seat positioning means includes an arcuate guide track which defines the arcuate path and which is provided on one of the frame and support structures. A plurality of rollers are rotatably supported on the other of the frame and support structure in disposition such that, the rollers engage the guide track to support the seat assembly on the support structure. These rollers are movable relative to the guide track to permit movement of the seat assembly relative to the support structure.

In addition to being useful in the manufacturing and maintenance fields, the inventive worker support apparatus is also capable of use in other operations. For example, in certain machines requiring an operator, the operator is frequently capable of controlling the machine or different operations thereof from any of a plurality of different positions. By employing the support apparatus in accordance with the present invention, it is possible to provide a support for the operator that gives him a large range of freedom of movement while providing constant ergonomic comfort. In this exemplary application, the seat assembly may be mounted on a support structure that is rotatable about a vertical axis so that the operator may selectively face in any direction relative to the machine in order to operate the different components thereon.

BRIEF DESCRIPTION OF THE DRAWING FIGURES

A preferred embodiment of the invention is described below with reference to the attached drawing figures, wherein:

FIG. 1 is a side view of a support apparatus constructed in accordance with the invention;

FIG. 2 is a top view of the support apparatus of FIG. 1;

FIG. 3 is a sectional view of the support apparatus taken along line 3—3 of FIG. 1;

FIG. 4 is a side view of a seat assembly constructed in accordance with the invention;

DETAILED DESCRIPTION OF THE PREFERRED EMBODIMENT

Figure 5:
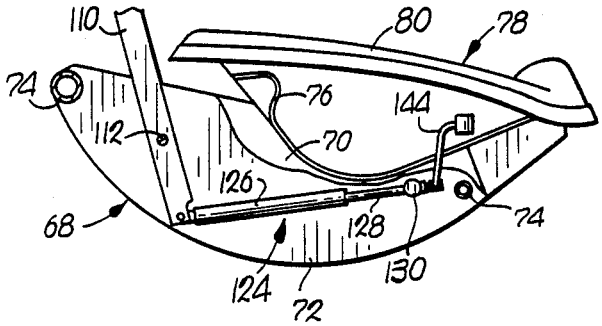
FIG. 5 is a side view similar to FIG. 4, with a portion of one frame plate broken away to illustrate a gas spring assembly employed in the preferred embodiment.

A preferred embodiment of a support apparatus constructed in accordance with the present invention is illustrated in the figures. With reference to FIG. 1, the apparatus includes a support structure 10 and a seat assembly 12.

The support structure includes a pair of horizontally spaced vertical walls 14, 16 extending the length of the apparatus from front-to-rear. As illustrated in FIG. 3, these walls 14, 16 are connected at the front of the apparatus by a V-shaped connecting wall 18 and at the rear by a rear wall 20. The rear wall 20 includes a pair of leg wall sections 22, 24 extending laterally outward of the vertical walls 14, 16 to define a triangular base having corners at the outer ends of the leg walls 22, 24 and at the center of the connecting wall 18.

Returning to FIG. 1, vertically extending cylindrical sleeves 26, 28, 30 are provided at the ends of the two leg walls 22, 24 and adjacent the center of the connecting wall 18 in which caster rollers 32 are mounted. These caster rollers 32 are adapted to support the structure 10 a small distance above a floor surface and to permit freedom of movement of the support apparatus in any direction along the floor. Wheel guards 34 may be provided on the caster rollers 32 to protect any cables or hoses running across the floor surface from being run over and pinched by the caster rollers 32 during movement of the apparatus.

The use of three wheels is preferred to other constructions since the three-wheel embodiment provides a more stable support base on floors having an uneven surface. However, where the problem of uneven floor surfaces is not a problem, any suitable structure may be employed to brace the support structure in a desired manner.

A tool tray 36, 38, as shown in FIG. 3, extends laterally from the lower edge of each of the vertical walls 14, 16 in a horizontal plane, and includes a side wall 40, 42 at the outer lateral edge thereof. These tool trays 36, 38 provide a convenient storage place for any implements typically used by a worker using the support apparatus and are located within easy reach of the worker. Adjacent the rear end of each of the tool trays 36, 38, a brake 44 is provided, as shown in FIG. 1, which is adapted to be movable into engagement with a floor surface to lock the support structure 10 from movement relative to the floor surface and to permit the worker to adjust other components of the apparatus without upsetting the position of the apparatus relative to the floor. In addition, the brakes permit the worker to quickly release the support apparatus from a locked position relative to the floor and to move the apparatus to any desired position beneath the product on which he is working. Thus, the worker has total freedom of movement when desired and can lock himself into any position that suits the job at hand.

Each of the brakes 44 preferably includes a lower brake member 46 that is pivotal about a horizontal axis 48 between a first position in which a resilient brake pad 50 on the member 46 is in contact with the floor, and a second position in which the pad 50 is out of contact with the floor. An actuator lever 52 extends upward from the brake member 46 and is movable with the brake member about the pivot axis 48 and is movable with the brake member about the pivot axis 48 while being further shiftable a short distance in the longitudinal direction of the pivot axis 48 to move a protrusion 54 on the lever 52 into and out of engagement with one of a pair of openings 56 in the side wall 40 or 42 of the tool tray 36 or 38 respectively.

Figure 10:
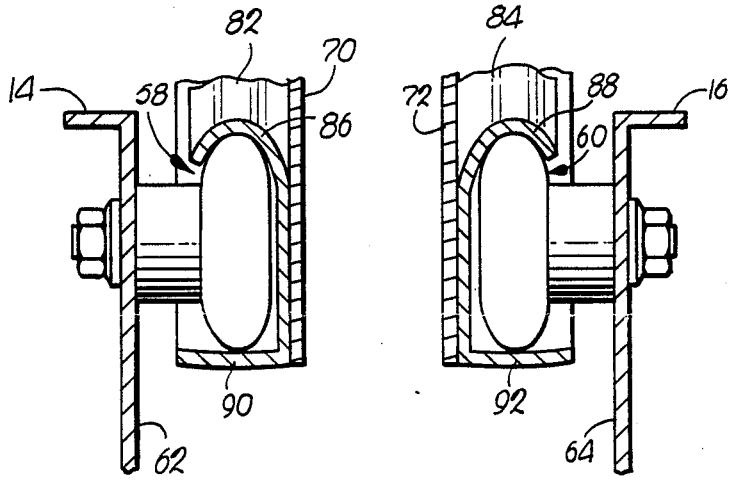
FIG. 10 is a front sectional view, partially cut away, of the track and roller assembly used in the support apparatus.

Turning to FIG. 10, the vertical walls 14, 16 of the support structure 10 define an open vertical space therebetween in which the seat assembly 12, described in detail below, is received. A pair of rollers 58 are attached to the inner surface 62 of the vertical wall 14 and a pair of rollers 60 are attached to the inner surface 64 of the vertical wall 16. These roller pairs 58, 60 are supported on the vertical walls 14, 16 such that the rollers are permitted to rotate about their axes of rotation but the axes of rotation of the rollers remain fixed relative to the support structure 10. In addition, as understood from FIG. 3, each roller 58 directly opposes a roller 60 of the roller pair mounted on the opposing vertical wall so that the roller pairs 58, 60 are symmetrical with respect to a longitudinal center line 66 of the support structure 10.

As illustrated in FIG. 4, the seat assembly 12 includes a frame 68 composed of a pair of crescent-shaped plates 70, 72 spaced from and attached to one another by a pair of spacers 74 that are welded to the opposing inner surfaces of the plates 70, 72. A mounting plate 76 is welded onto the upper edges of the plates 70, 72 and receives a seat 78 thereon. The seat 78, in turn, includes a seat pad 80, shown in plan view in FIG. 2, which is molded to conform with the hips and lower back of a human being so as to provide a minimum number of pressure points against the human being's body as possible during use of the apparatus. Thus, the seat pad 80 is of ergonomic design which permits a person to remain in the seat for an extended period of time without developing physical stress.

From FIG. 10, it can be seen that the plates 70, 72 each include a guide track 82, 84 mounted on a laterally outer surface of the plate along substantially the entire lower edge thereof. These guide tracks 82, 84 are aligned with one another both vertically and horizontally and, as shown in FIG. 4, are of an arcuate, preferably circular arc shape defining an arcuate path of travel along which the seat assembly 12 may be moved relative to the support structure 10. Returning to FIG. 10, each of the guide tracks includes an upper track segment 86, 88 having a generally V-shaped angle adapted to engage and guide the radially outer surfaces of the support structure rollers 58, 60, and a lower flange 90, 92 adapted to retain the rollers within the guide track to prevent the rollers from becoming disengaged from the guide track.

Figure 6:
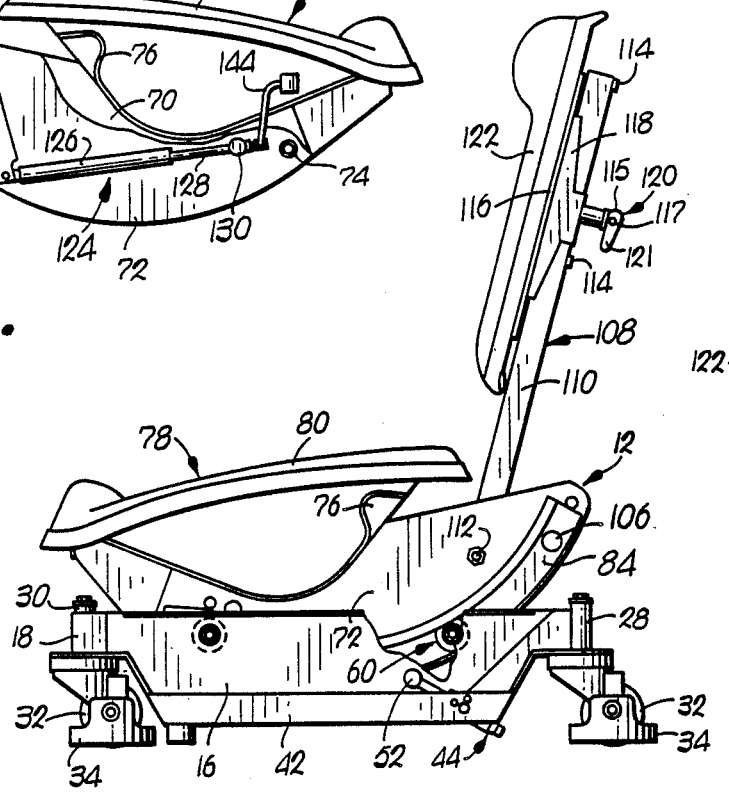
FIG. 6 is a side view of the support apparatus with a portion of one vertical wall of the support structure broken away.
Figure 7:
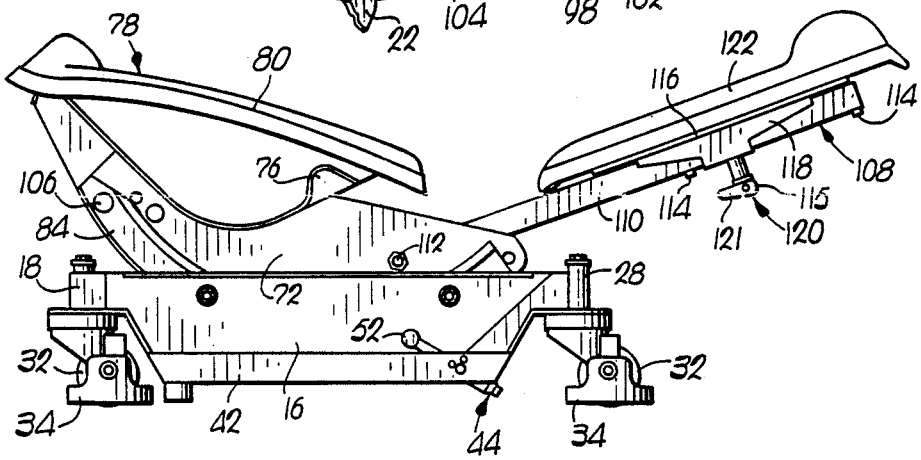
FIG. 7 is a side view similar to FIG. 6 showing the support assembly in a second selected position thereof.

As thus far described, the seat assembly 12 is freely movable relative to the support structure 10 along the path defined by the guide tracks 82, 84 between an extreme rearward position, shown in FIGS. 1 and 6, in which the seat 78 is disposed to place a human being in a substantially seated position, and an extreme forward position, illustrated in FIG. 7, in which the seat 78 is disposed to tilt the hips and lower back of the human being rearward so that the human being is in a generally supine position. In addition, regardless of the position of the seat assembly 12, the seat 78 is always disposed at an angle and height relative to the floor which will permit the feet of the ordinary user to reach the floor, thus permitting the user to retain a certain amount of balance which naturally results from such floor contact.

Figure 8:
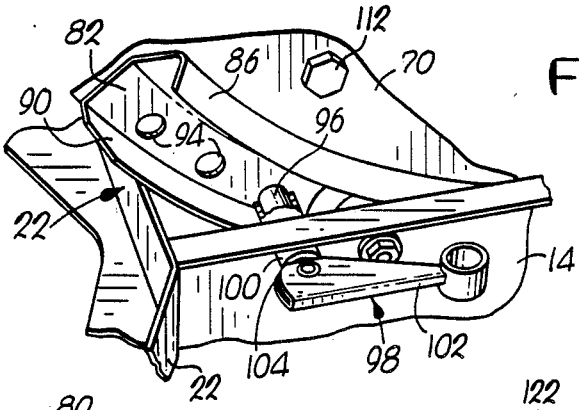
FIG. 8 is a perspective view, partially broken away, of a locking mechanism employed in the preferred embodiment.

In order to lock the seat assembly 12 into a desired position once the assembly has been oriented relative to the support structure 10, one of the guide tracks 82 and the frame plate 70 adjacent thereto are provided with a plurality of holes 94 which are selectively engaged by an axially movable pin 96 of a locking mechanism 98 on the support structure 10. As shown in FIG. 8, the holes 94 are disposed within the arcuate guide path of the track 82 to be properly aligned with the pin 96 during movement of the seat assembly 12 relative to the support structure 10, and although only four holes 94 are shown, it is possible to include as many holes as are deemed necessary to provide a desired number of selectable positions at which the seat assembly 12 may be locked.

Alternatively, it is possible to provide a locking mechanism on the support structure 10 having a brake which engages either the guide tracks or the frame plates directly to prevent movement of the seat assembly relative to the support structure at any of an infinite number of positions. Thus, the invention is not limited to a seat assembly that is limited to being positioned in only a finite number of positions.

The locking mechanism illustrated in FIG. 8 includes a sleeve 100 passing horizontally through one of the vertical walls 14 of the support structure 10 for receiving the pin 96. A lever 102 is pivotally connected to an end of the pin 96 remote from the guide track 82 and extends in a direction generally perpendicular to the axis of the pin 96. The lever 102 includes a cam surface 104 adjacent the pivot axis thereof which abuts an end of the sleeve 100 such that when the lever 102 is pivoted relative to the pin, the cam surface 104 engages the sleeve 100 to force the pin 96 out of an adjacent hole 94 in the guide track 82.

Figure 9:
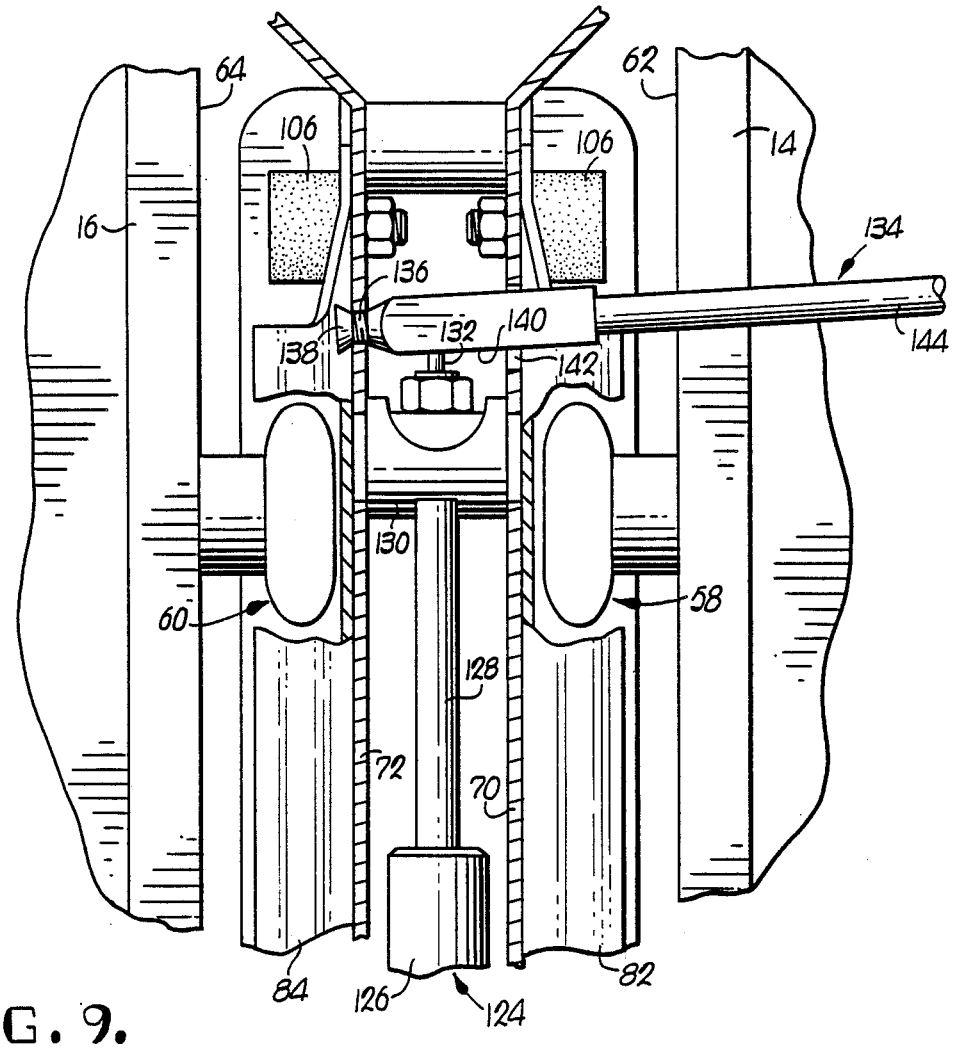
FIG. 9 is a sectional plan view, partially broken away, taken below the seat of the apparatus.

In addition to the mechanism 98 for locking the seat assembly 12 relative to the support structure 10, movement limiting stops 106 are also provided, as shown in FIGS. 6 and 9, for limiting the movement of the seat assembly 12. Two of the stops 106 are provided at the front of the tracks for limiting movement of the seat assembly in the rearward direction, while a third stop 106 is positioned at the rear end of one guide track 84 for limiting forward movement of the assembly 12.

Figure 11:
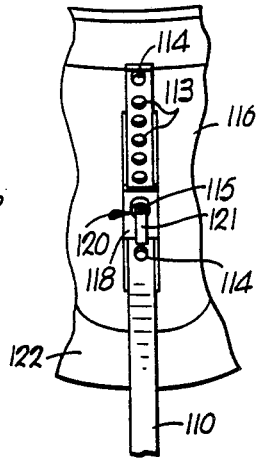
FIG. 11 is a rear view partially cut away of the back support.

Turning to FIG. 6, a back support 108 is provided on the seat assembly 12 and includes a back support member 110 pivotally supported adjacent its lower end on a shaft 112 extending between the two frame plates 70,72. The back support member 110 is shown in FIG. 11, and includes a substantially straight hollow bar having a generally rectangular cross section. A number of aligned openings 113 are provided in the rear surface of the member 110 extending between a pair of stops 114. A pad support plate 116 includes a hollow rectangular sleeve 118 adpated to engage the outer surface of the back support member 110, and a position locking assembly 120 similar to the locking mechanism 98 discussed above. The locking assembly 120 includes an axially movable pin (not shown) that is selectively movable into and out of engagement with the openings 113 in the back support member 110 by means of a cam 115 connected to the pin at a pivot axis 117.

By providing this arrangement, the pad support plate 116 is movable along the length of the back support member 110 and may be locked in any one of a plurality of positions relative to the back support member. In addition, as with the locking mechanism 98, the locking assembly 120 may be replaced by a brake type assembly capable of locking movement of the pad support plate at any of an infinite number of positions relative to the back support member.

A back support pad 122, shown in FIG. 6, is attached to the plate 116 and is movable therewith along the back support member 110 so as to be selectively positionable relative to the back support member. The pad 112, like the seat pad 80, is ergonomically designed to provide maximum comfort to a user without causing accelerated fatigue or physical stress. In addition, the pad 122 may include a neck support pad either as an integral part thereof as shown, or as a separate pad element, in order to provide further support to the user. Where the neck pad is made as a separate element, it is also possible to make it adjustable relative to the back support pad by mounting the neck pad on a separate plate which is pivotal relative to the back support plate.

In order to lock the back support member 110 in a desired position relative to the seat 78, a gas spring assembly 124, such as that shown in FIG. 5, is provided adjacent the lower end of the member 110. The gas spring assembly 124 is disposed between the frame plate 70,72 of the seat assembly 12 and includes a cylinder 126 attached to the lower end of the back support member 110 and a piston rod 128 extending from the end of the cylinder 126 remote from the member 110. The piston rod 128 in turn is fixed to the frame plates 70,72 of the seat assembly by a cylindrical shaft 130 which extends in a direction perpendicular to the piston rod 128 through openings in the frame plates and which is freely rotatable in the openings. From FIG. 9, it can be seen that an actuator button 132 extends from the end of the piston rod 128 remote from the cylinder 126, and functions, when depressed, to permit relative movement between the cylinder 126 and the rod 128. Once the button 132 is released however, the piston rod 128 is locked relative to the cylinder 126 and no further relative movement between the cylinder and rod in either direction is permitted.

A spring (not shown) is provided in the cylinder 126 to bias the piston rod 128 toward an extended position so that the back support member 110 is moved to a substantially upright orientation under the force of the spring when no manual pressure is exerted on the back support 110. In this manner, it is possible for a user to adjust the back support 108 either by leaning against the back support while actuating the button 132, or by leaning forward away from the back support while actuating the button. Thus, it is not necessary that the user reach back and pull the back support to the upright position.

An actuator lever 134, shown in FIG. 9, is provided on the seat assembly 12 adjacent the button 132 for permitting the button to be depressed conveniently by a user sitting in the seat. One end of the lever 134 is provided with a reduced diameter throat section 136 defined between the end of the lever 134 and the conical head of a threaded element 138 inserted in the end of the lever 134. The throat section 135 is received in an opening in one of the frame plates 72 for retaining the lever 134 on the frame plate while permitting substantially pivotal movement of the lever 134 relative to the plate 72. A contact surface 140 of the lever 134 extends between the frame plates 70,72 and is adapted to contact the button 132 when the lever 134 is moved rearward with respect to the gas spring assembly 124. The other frame plate 70 is provided with a horizontally extending slot 142 that guides the lever 134 during horizontal movement of the lever and properly orients the lever so that the contact surface 140 engages the button 132. The lever 134 also includes a handle 144, shown in FIG. 5, that is bent upward toward the seat 78 to facilitate gripping and operation of the lever by a user.

Having thus described the preferred construction of the support apparatus, a discussion will now be provided of the manner in which a user might adjust the apparatus from a substantially upright seated position, such as that shown in FIGS. 1 and 5, to a substantially supine position such as that illustrated in FIG. 7.

Once the user has rolled the support structure to a desired work location and pivoted the brakes to their braking positions, he then pivots the lever of the locking mechanism 98 to force the pin 96 from engagement with the hole 94 in the frame plate 70. Thereafter, the seat assembly 12 is freely movable along the path defined by the guide tracks 80, 84 and may be positioned so that any one of the holes 94 in the frame plate 70 are adjacent the pin 96. The user then releases the lever 102 and pin 96 engages the hole 94 to lock the seat assembly 12 relative to the support structure 10.

If the back support 108 is also to be adjusted, the actuator lever 134 is pushed toward the rear of the apparatus so that the contact surface 140 of the lever 134 contacts and depresses the button 132 on the piston rod 128 of the gas spring assembly 124. While holding the lever 134 in its rearward position, the user then leans back against the back support 108 and manually pivots the back support member 110 about the pivot shaft 112 until the desired inclination of the support 108 is achieved. Upon releasing the lever 134, the button 132 will be released and the back support 108 will be locked against additional movement relative to the seat assembly 12. Further, if the user wishes to raise the back support member 110 he need only forward out of contact with the back support pad 122 while actuating the button 132 so that the spring within the cylinder 126 will bias the back support member 110 toward a more upright position.

Because the pivot shaft 112 of the back support member 110 is offset from the hips or waist of the user, which define the natural axis about which the user pivots, a certain amount of displacement occurs between many given point of the user's back and the corresponding point on the back support pad 122. Thus, e.g., if a user's head is properly aligned with the upper edge of the pad 122 when the back support 108 is in an upright position, then his head will contact a point lower on the pad when the back support member 110 has been pivoted to a more horizontal position.

In order to correct for any discomfort resulting from such an occurrence, the back support pad 122 is axially movable along the back support member 110. Thus, once the back support member 110 has been properly adjusted, the locking assembly lever 121 may be pivoted to release the pin of the assembly 120 from the associated opening 113 in the member 110, and the support plate 116 can be manually moved to a desired position at which another of the openings in the back support member 110 opposes the assembly 120. Thus, three different adjustments may be carried out on the seat assembly 12 relative to the support structure 10.

Although the invention has been described with reference to the above-described preferred embodiment, it is understood that substitutions may be made and equivalents employed herein, without departing from the scope of the invention as set forth in the claims. For example, it is possible to provide yet another type of motion of the seat assembly relative to the support structure by supporting the seat assembly on an intermediate support member that is vertically adjustable relative to the support structure. In accordance with this construction, the intermediate member is constructed as a hollow member having a pair of vertical walls spaced from one another by a distance sufficient to receive the support assembly. On these vertical walls, two opposing pairs of rollers are mounted in the same manner as the roller pairs are mounted on the support structure in the preferred embodiment, so as to be rotatable about their axes, with the axes fixed relative to the vertical walls of the intermediate member, and a locking mechanism similar to the mechanism 98 is provided to engage openings in the tracks of the seat assembly.

The intermediate member of this alternate construction is received between two vertical walls of the support structure and is retained on the mits adjustment of the height of the intermediate member relative to the support structure. For example, a number of holes could be provided in the walls of the intermediate member, and a locking mechanism similar to the mechanism 98 employed with the seat assembly 12 could be provided on the support structure.

What is claimed is:

1. A low-profile positioning apparatus for selectively supporting a worker in one of a plurality of positions beneath a structure to be worked on by the worker, the apparatus comprising:

a support structure including a pair of walls which are spaced from one another in the horizontal direction and which include opposing vertical wall surfaces;

a seat assembly including a frame, a seat and a back support member, the frame having a width in the horizontal direction which is less than the distance by which the pair of walls of the support structure are spaced and a pair of opposing frame surfaces extending between the opposing vertical wall surfaces of the support structure, the seat and back support member being mounted on the frame for movement with the frame;

seat assembly positioning means for permitting movement of the frame relative to the support structure along an upright arcuate path to selectively position the seat assembly in one of a plurality of positions relative to the support structure and disposed horizontally between one of the frame surfaces and an adjacent vertical wall surface; and back support positioning means for permitting pivotal movement of the back support member relative to the frame to selectively position the back support member in one of a plurality of positions relative to the seat.

2. The support apparatus according to claim 1, further comprising seat assembly locking means for locking the seat assembly against movement relative to the support structure once the seat assembly has been selectively positioned.

3. The support apparatus according to claim 1, wherein the back support member includes a pad and pad positioning means for permitting movement of the pad relative to the back support member to selectively position the pad in one of a plurality of positions relative to the back support member.

4. The support apparatus according to claim 3, wherein the back support member is pivotal about a pivot axis and the pad is movable relative to the back support member in a direction radial to the pivot axis.

5. The support apparatus according to claim 3, further comprising pad locking means for locking the pad against movement relative to the back support member once the pad has been selectively positioned.

6. The support apparatus according to claim 1, further comprising back support locking means for locking the back support member against movement relative to the seat assembly once the back support member has been selectively positioned so that the relative orientation of the back support member and the seat does not change during positioning of the seat assembly.

7. The support apparatus according to claim 1, wherein the support structure includes a set of wheels adapted to support the support structure above a floor, the support structure further including support structure locking means for selectively locking the support structure in one of a plurality of different positions relative to the floor.

8. The support apparatus according to claim 7, wherein the set of wheels includes three wheels arranged in a triangular configuration on the support structure.

9. The support apparatus according to claim 7, wherein the support structure locking means includes at least one brake mounted on the support structure and including a handle, the brake being selectively movable into and out of engagement with the floor.

10. The support apparatus according to claim 1, wherein the support structure includes at least one tray disposed beneath the seat assembly.

11. The support apparatus according to claim 1, wherein the arcuate path is disposed within a substantially vertical plane and the back support member is mounted on the frame for movement about a pivot axis extending in a direction substantially perpendicular to the plane of the arcuate path.

12. The support apparatus according to claim 11, wherein the arcuate path is an arc of a circle having a center of curvature located vertically above the arcuate path.

13. A support apparatus for selectively supporting a worker in one of a plurality of positions, the apparatus comprising:

a support structure including a pair of walls which are spaced from one another in the horizontal direction and which include opposing vertical wall surfaces;

a seat assembly including a frame, a seat and a back support member, the seat and back support member being mounted on the frame for movement with the frame;

seat assembly positioning means for permitting movement of the frame relative to the support assembly along an upright arcuate path to selectively position the seat assembly in one of a plurality of positions relative to the support structure, a first pair of the plurality of rollers being rotatably mounted on one of the opposing vertical wall surfaces and another pair of the plurality of rollers being rotatably mounted on another of the opposing wall surfaces, the frame of the seat assembly including a first arcuate guide track for engaging the first pair of rollers and a second arcuate guide track for engaging the second pair of rollers; and back support positioning means for permitting pivotal movement of the back support member relative to the frame to selectively position the back support member in one of a plurality of positions relative to the seat.

14. A low-profile support apparatus for selectively supporting a worker in one of a plurality of positions ranging between a substantially horizontal supine position and an upright seated position, the apparatus comprising;

a support structure;

a seat assembly including a frame, a seat and a back support member, the seat and back support member being mounted on the frame for movement therewith;

seat assembly positioning means for permitting movement of the seat assembly relative to the support structure along an upright arcuate path to selectively position the seat assembly in one of a plurality of positions relative to the support structure;

the seat assembly positioning means including an arcuate guide track which defines the arcuate path and which is provided on one of the frame and support structure, and a plurality of rollers rotatably supported on the other of the frame and support structure, the rollers engaging the guide track to support the seat assembly on the support structure and being movable relative to the guide track to permit movement of the seat assembly relative to the support structure;

back support positioning means for permitting pivotal movement of the back support member relative to the frame to selectively position the back support member in one of a plurality of positions relative to the seat, the seat assembly positioning means and the back support positioning means together enabling support of a worker in any one of a plurality of positions ranging between a substantially horizontal supine position and an upright seated position.

15. The support apparatus according to claim 14, wherein the arcuate path is an arc of a circle having a center of curvature located vertically above the arcuate path.

16. The support apparatus according to claim 15, wherein the seat is disposed between the center of curvature of the arcuate path and the guide track.

17. The support apparatus according to claim 14, further comprising support structure locking means for selectively locking the support structure in one of a plurality of positions relative to a floor on which the apparatus is supported.

18. A support apparatus for selectively supporting a worker in one of a plurality of positions, the apparatus comprising:

a support structure;

a seat assembly including a frame and a seat mounted on the frame for movement therewith;

a seat positioning means for permitting movement of the seat assembly relative to the support structure along an upright arcuate path to selectively position the seat assembly in one of a plurality of positions relative to the support structure the seat positioning means including an arcuate guide track which defines the arcuate path and which is provided on one of the frame and support structure, and a plurality of rollers rotatably supported on the other of the frame and support structure, the rollers engaging the guide track to support the seat assembly on the support structure and being movable relative to the guide track to permit movement of the seat assembly relative to the support structure; and support structure locking means for selectively locking the support structure in one of a plurality of positions relative to a floor on which the apparatus is supported, the locking means including at least one brake mounted on the support structure and including a handle, the brake being selectively movable into and out of engagement with the floor.

* * * * *